US006585046B2

(12) United States Patent
Neuroth et al.

(10) Patent No.: US 6,585,046 B2
(45) Date of Patent: Jul. 1, 2003

(54) LIVE WELL HEATER CABLE

(75) Inventors: David H. Neuroth, Claremore, OK (US); Phillip R. Wilbourn, Claremore, OK (US); Larry V. Dalrymple, Claremore, OK (US); Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 23 days.

(21) Appl. No.: 09/939,902

(22) Filed: Aug. 27, 2001

(65) Prior Publication Data

US 2002/0023751 A1 Feb. 28, 2002

Related U.S. Application Data

(60) Provisional application No. 60/228,543, filed on Aug. 28, 2000.

(51) Int. Cl.[7] ..... E21B 36/04
(52) U.S. Cl. ..... 166/302; 166/65.1
(58) Field of Search ..... 166/369, 372, 166/302, 57, 62, 65.1

(56) References Cited

U.S. PATENT DOCUMENTS

| | | | | |
|---|---|---|---|---|
| 4,572,299 A | * | 2/1986 | Vanegmond et al. | 166/385 |
| 5,782,301 A | | 7/1998 | Neuroth et al. | 166/302 |
| 6,009,940 A | * | 1/2000 | Eck et al. | 166/60 |
| 6,103,031 A | | 8/2000 | Aeschbacher et al. | 156/54 |
| 6,260,615 B1 | | 7/2001 | Dalrymple et al. | 166/60 |

OTHER PUBLICATIONS

Patent application Ser. No. 09/824,283, Filed Apr. 2, 2001 entitled "Method for Decreasing Heat Transfer from Production Tubing".

* cited by examiner

*Primary Examiner*—William Neuder
(74) *Attorney, Agent, or Firm*—Bracewell & Patterson, L.L.P.

(57) ABSTRACT

A method of heating gas being produced in a well reduces condensate occurring in the well. A cable assembly having at least one insulated conductor is deployed into the well while the well is still live. Electrical power is applied to the conductor to cause heat to be generated. Gas is allowed up past the cable assembly and out the wellhead. The heat retards condensation, which creates frictional losses in the gas flow.

21 Claims, 7 Drawing Sheets

LIVE WELL HEATER CABLE

CROSS-REFERENCE TO RELATED APPLICATION

This application claims the benefit of provisional patent application Ser. No. 60/228,543, filed Aug. 28, 2000.

FIELD OF INVENTION

This invention relates in general to wells that produce gas and condensate and in particular to a heater cable deployable while the well is live for raising the temperature of the gas being produced to reduce the amount of condensate.

BACKGROUND OF THE INVENTION

Many gas wells produce liquids along with the gas. The liquid may be a hydrocarbon or water that condenses as the gas flows up the well. The liquid my be in the form of a vapor in the earth formation and lower portions of the well due to sufficiently high pressure and temperature. The pressure and the temperature normally drop as the gas flows up the well. When the gas reaches or nears its dew point, condensation occurs, resulting in liquid droplets. Liquid droplets in the gas stream cause a pressure drop due to frictional effects. A pressure drop results in a lower flow rate at the wellhead. The decrease in flow rate due to the condensation can cause significant drop in production if quantity and size of the droplets are large enough. A lower production rate causes a decrease in income from the well. In severe cases, a low production rate may cause the operator to abandon the well.

Applying heat to a well by the use of a downhole heater cable has been done for wells in permafrost regions and to other wells for various purposes. In one technique in permafrost regions, the production tubing is pulled out of the well and a heater cable is strapped onto the tubing as it is lowered back into the well. One difficulty with this technique in a gas well is that the well would have to be killed before pulling the tubing. This is performed by circulating a liquid through the tubing and tubing annulus that has a weight sufficient to create a hydrostatic pressure greater than the formation pressure. In low pressure gas wells, killing the well is risky in that the well may not readily start producing after the killing liquid is removed. The kill liquid may flow into the formation, blocking the return of gas flow.

Another problem associated within the use of heater cable is to avoid loss of the heat energy through the tubing annulus to the casing and earth formation. This lost heat is not available to increase the temperature of the produced gas and significantly increases heating costs. It is also known to thermally insulate at least portion s of the production tubing in various manner to retard heat loss.

SUMMARY

In this invention a method of heating gas being produced in a well is provided to reduce condensate occurring in the well. A cable assembly having at least one insulated conductor is coiled on a reel and transported to a well site. The cable assembly is deployed from the reel into the well while the well is still live. A pressure controller is preferably used at the upper end of the production tubing to install the cable while the well is live. Electrical power is supplied to the conductor to cause heat to be generated. Gas flows up past the cable assembly and out the wellhead.

Preferably, there is a plurality of conductors in the cable, and the lower ends are secured together. Also, preferably, the cable is contained within a coiled tubing. Heat transfer from the cable may be increased by providing a dielectric liquid in the tubing annulus, by drawing a vacuum in the tubing annulus, or by applying heat reflective coatings to the tubing and/or the casing. The cable may be divided into sections, with some of the sections providing more heat than others.

DESCRIPTION OF PREFERRED EMBODIMENTS

Figure 1:
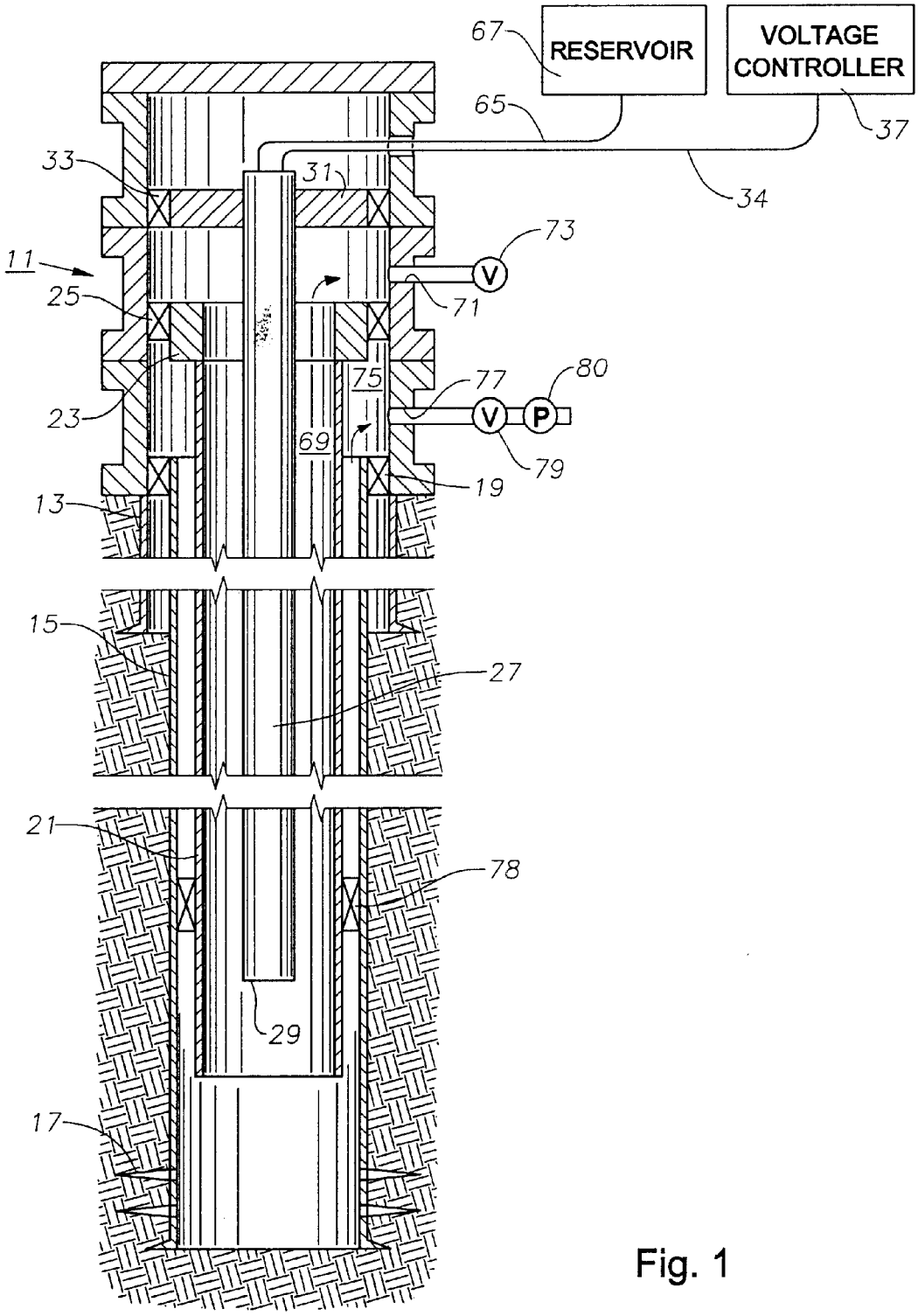
FIG. 1 is a schematic view of a well having a heater cable installed in accordance with this invention.

Referring to FIG. 1, wellhead 11 is schematically shown and may be of various configurations. Wellhead 11 is located at the surface or upper end of a well for controlling flow from the well. Wellhead 11 is mounted to a string of conductor pipe 13, which is the largest diameter casing in the well. A string of production casing 15 is supported by wellhead 11 and extends to a greater depth than conductor pipe 13. There may be more than one string of casing within conductor pipe 11. In this example, production casing 15 is perforated near the lower end, having perforations 17 that communicate a gas bearing formation with the interior of production casing 15. A casing hanger 19 and packoff support and seal the upper end of production casing 15 to wellhead 11. Conductor pipe 13 and production casing 15 are cemented in place.

Figure 1A:
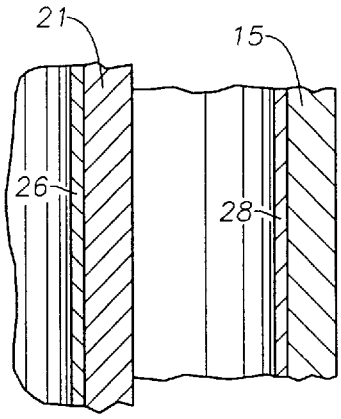
FIG. 1*a* is a partial sectional view of the production tubing of the well of FIG. 1.

In this embodiment, a string of production tubing 21 extends into casing 15 to a point above perforations 17. Tubing 21 has an open lower end for receiving flow from perforations 17. Tubing hanger 23 supports the string of tubing 21 in wellhead 11. A packoff 25 seals tubing hanger 23 to the bore of wellhead 11. Production tubing 21 may be conventional, or it may have a liner 26 within its bore, as shown in FIG. 1A. Liner 26 is a reflective coating facing inward for retaining heat within tubing 21. Liner 26 may be made of plastic with a thin metal film that reflects heat loss back into the interior of tubing 21. Alternately, liner 26 may be a plating on the inside of tubing 21 of a very thin layer of nickel, chrome or other highly reflective coating. Furthermore, in addition or in the alternative, a heat reflective plating or liner 28 of similar material could be located on the inner diameter of casing 15.

In the embodiment shown in FIG. 1, a string of coiled tubing 27 extends into tubing 21 to a selected depth. The depth need not be all the way to the lower end of production tubing 21. Coiled tubing 27 is a continuous string of pipe of metal or other suitable material that is capable of being wrapped around a reel and deployed into the well. Production tubing 21, on the other hand, is made up of individual sections of pipe, each about 30' in length and secured together by threads. Coiled tubing 27 has a closed lower end 29 and thus the interior is free of communication with any of the production fluids. Coiled tubing hanger 31 and packoff 33 seal and support coiled tubing 27 in the bore of wellhead 11.

Figure 2:
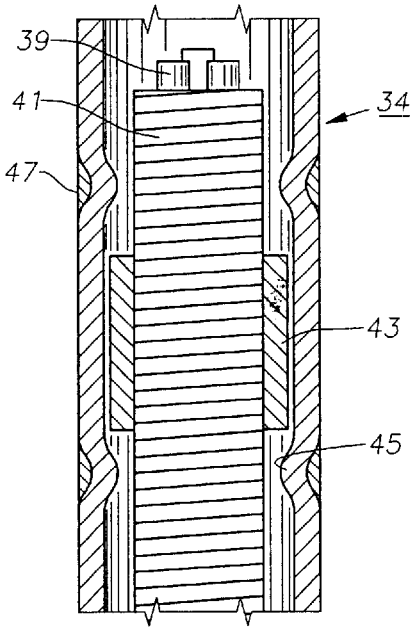
FIG. 2 is an enlarged side view of a portion of the heater cable of FIG. 1.
Figure 3:
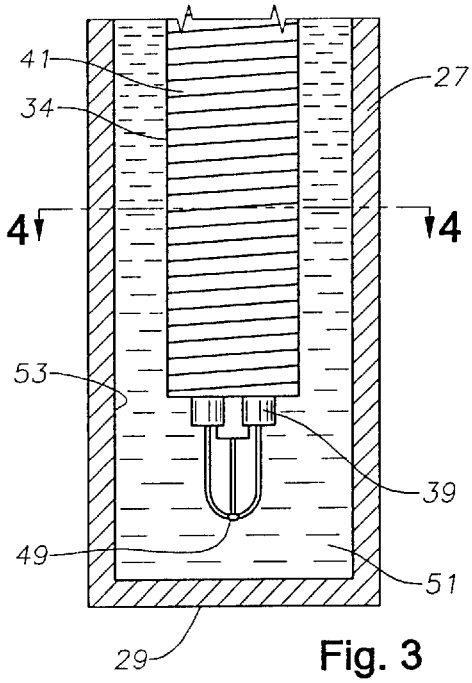
FIG. 3 is an enlarged side view of a lower portion of the heater cable of FIG. 1.
Figure 4:
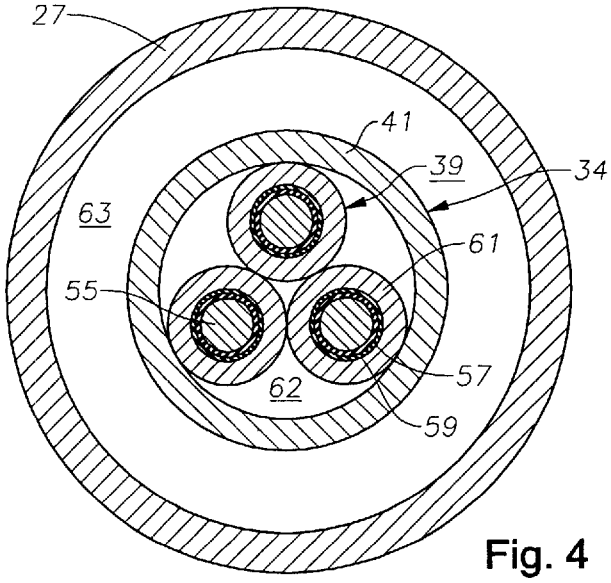
FIG. 4 is a sectional view of the heater cable of FIG. 3, taken along the line 4—4 of FIG. 3.

An electrical cable 34 is located inside coiled tubing 27, as illustrated in FIGS. 2–4, thus coiled tubing 27 may be considered to be a metal jacket that is a part of electrical cable 34. Electrical cable 34 is installed in coiled tubing 27 while the coiled tubing is stretched out horizontally on the surface. It may be installed by pumping through a chase line, then pulling electrical cable 34 into coiled tubing 27 with the chase line. Electrical cable 34 is of a type that is adapted to emit heat when supplied with power and maybe constructed generally as shown in U.S. Pat. No. 5,782,301, all of which material is incorporated by reference. A voltage controller 37 supplies power to electrical cable 34 to cause heat to be generated.

Referring to FIG. 2, in the first embodiment, electrical cable 34 has a plurality of insulated conductors 39 (three in the preferred embodiment) and an outer wrap of armor 41. Armor 41 comprises a metallic strip that is helically wrapped around insulated conductors 39. Electrical cable 34 does not have the ability to support its own weight in most gas wells. Anchoring devices are employed in this embodiment to transfer the weight of cable 34 to coiled tubing 27. The anchoring devices in this embodiment comprise a plurality of clamps 43 secured to armor 41 at various points along the length of electrical cable 34. A plurality of dimples 45 are formed in coiled tubing 27 above and below each of the clamps 43. While in a vertical position, the weight of electrical cable 34 will be transferred from clamps 43 to dimples 45, and thus to coiled tubing 27. A weldment 47 is filled in each dimple 45 on the outer surface of coiled tubing 27 to provide a smooth cylindrical exterior for snubbing operations. There are other types of anchoring devices available for transferring the weight of electrical cable 34 to coiled tubing 27 position, the weight of electrical cable 34 will be transferred from clamps 43 to dimples 45, and thus to coiled tubbing 27. A weldment 47 is filled in each dimple 45 on the outer surface of coiled tubing 27 to provide a smooth cylindrical exterior for snubbing operations. There are other types of anchoring devices available for transferring the weight of electrical cable 34 to coiled tubing 27.

Referring to FIG. 3, insulated conductors 39 are secured together at the lower end at a lower termination 49. At lower termination 49, insulated conductors 39 will be placed in electrical continuity with each other. Lower termination 49 is wrapped with an insulation. Also, in the first embodiment, a dielectric liquid 51 is located in coiled tubing 27 in a chamber 53 at closed lower end 29.

FIG. 4 illustrates more details of electrical cable 34. Each insulated conductor 39 has a central copper conductor 55 of low resistivity. In this embodiment, the insulation includes two layers 57, 59 around each copper conductor 55. The inner layer 57 in this embodiment is a polyamide insulation while the outer layer 59 is a polyamide insulation. A lead sheath 61 is extruded around insulation 59 for assisting in conducting heat. Lead sheath 61 is in physical contact with armor 41. The three insulated and sheathed conductors 55 are twisted together. Cavities 62 exist along electrical cable 34 within armor 41 and between insulated conductors 39. Cavities 62 are preferably filled with the dielectric liquid 51 (FIG. 3) for conducting heat away from insulated conductors 39. Similarly, an inner annulus 63 surrounds armor 41 within coiled tubing 27. Inner annulus 63 is filled with the same dielectric liquid 51 (FIG. 3) as in cavity 62 because armor 41 does not form a seal. The dielectric liquid 51 in inner annulus 63 assists in transferring heat away from cable 34. This not only enhances heat transfer to gas flowing within the well but also avoids excessive heat from damaging electrical cable 34.

Referring again to the embodiment of FIG. 1, a siphon tube 65 leads from a syphon reservoir 67 to inner annulus 63. Siphon tube 65 extends laterally through a port in wellhead 11. Reservoir 67 contains dielectric fluid 51 (FIG. 3) and is typically located above the upper end of coiled tubing 27. Thermal expansion will cause dielectric liquid 51 to flow into siphon tube 65 and up into reservoir 67. When power to electrical cable 34 is turned off, the resulting cooling will cause dielectric fluid 51 to flow out of reservoir 67 and back through siphon tube 65 into coiled tubing 27.

Referring still to FIG. 1, an intermediate annulus 69 surrounds coiled tubing 27 within production tubing 21. This constitutes the main production flow path for gas from the well, the gas flowing out intermediate annulus 61 and through a flow line 71 that contains a valve 73. Also, an outer annulus 75 surrounds production tubing 21. A packer 78 seals production tubing 21 to production casing 15 near the lower end of tubing 21, forming a closed lower end for outer annulus 75.

A port 77 extends through wellhead 11 in communication with outer annulus 75. Port 77 is connected to a line that has a valve 79 and leads to a vacuum pump 80. Vacuum pump 80, when operated will create a vacuum or negative pressure less than atmospheric within outer annulus 75. The vacuum created within outer annulus 75 comprises a fluid of low thermal conductivity and low density to reduce heat loss from tubing 21 to the earth formation. Alternately, the fluid of low thermal conductivity within outer annulus 75 could be a liquid of low thermal conductivity and preferably high viscosity such as a crude oil with a viscosity of 1000 centipoise or higher.

Many gas wells are in remote sites not served by electrical utilities. In such cases, some of the gas production from tubing 21 could be used to power an engine driven electrical generator. The electricity from the generator would be used to power heater cable 34.

Briefly discussing the operation, voltage controller 37 will deliver and control a supply of electrical power to electrical cable 34. This causes heat to be generated, which warms gas flowing from perforations 17 up intermediate annulus 69. The amount of heat is sufficient to raise the temperature of the gas to reduce condensation levels that are high enough to restrict gas flow. The temperature of the gas need not be above its dew point, because it will still flow freely up the well so long as large droplets do not form, which fall due to gravity and restrict gas flow. Some condensation can still occur without adversely affecting gas flow. The amount of heat needs to be only enough to prevent the development of a large pressure gradient in the gas flow stream due to condensation droplets.

The dew point is the temperature and pressure at which liquid vapor within the gas will condense into a liquid. The condensate may be a hydrocarbon, such as butane, or it may be water, or a combination of both. If significant condensate forms in the well, large droplets and slugs of liquid develop, which create friction. The friction drops the pressure and lowers the production rate. Preferably, heater cable 34 supplies enough heat to maintain the gas at a temperature sufficient to prevent frictional losses due to formation of condensate. The gas can be below the dew point in a cloudy state without detriment to the flow rate because large droplets of condensate are not produced in the cloudy state. Eliminating condensate that causes frictional losses allows the pressure to remain higher and increases the rate of production. The water and hydrocarbon vapors that remain in the gas will be separated from the gas at the surface by conventional separation equipment.

Figure 5:
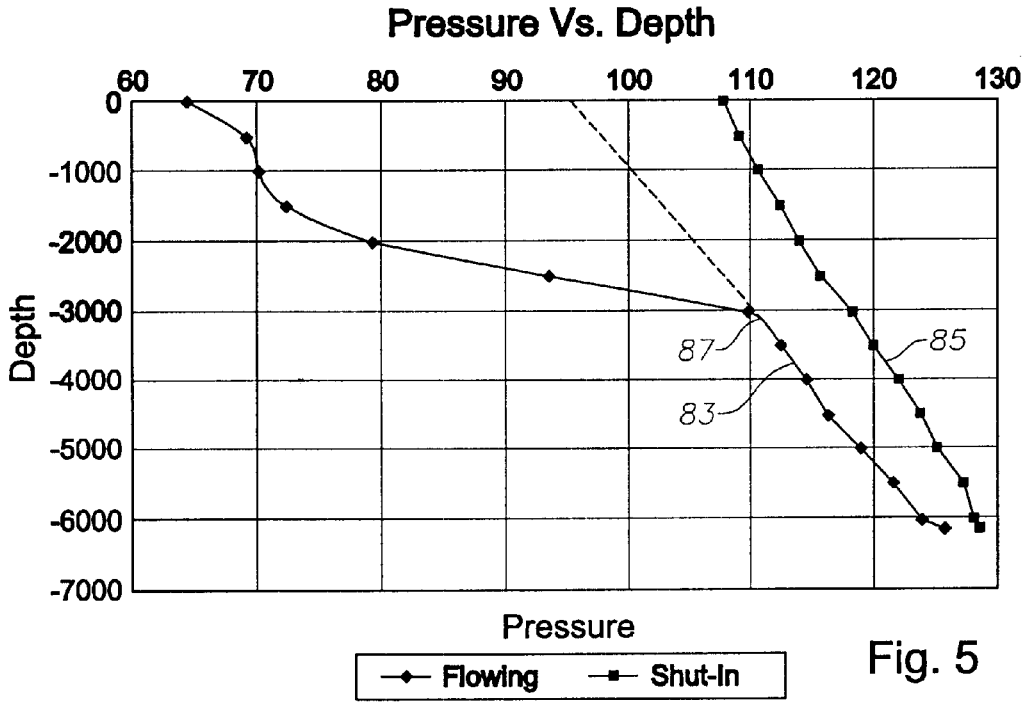
FIG. 5 is a graph of pressure versus depth for a well in which heater cable in accordance with this invention was installed.
Figure 6:
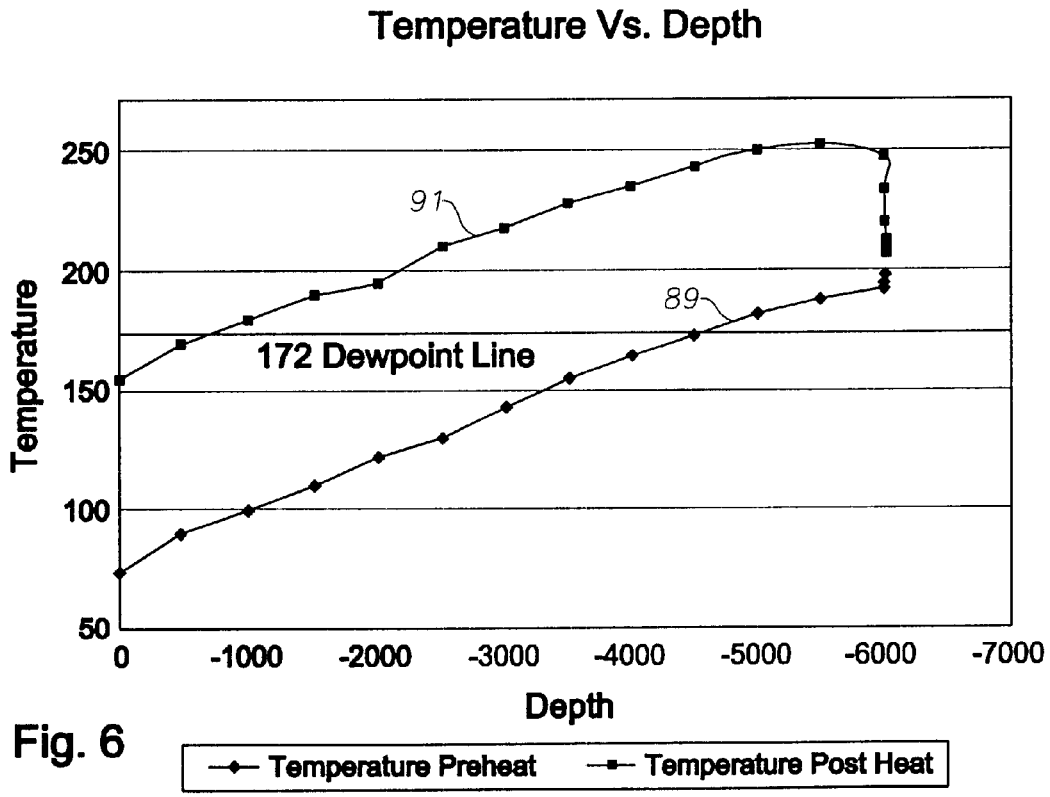
FIG. 6 is a graph of temperature versus depth for a well in which heater cable in accordance with this invention was installed, measured after installation of a heater cable and with power on and off to the heater cable.

FIGS. 5 and 6 represent measurements of a test well in which a heater cable was employed. FIG. 5 is a graph of pressure versus the depth of the well without heat being supplied by heater cable 34 (FIG. 1). Plot or curve 81 represents pressure data points taken at various depths in the well while the well was not flowing, rather was shut in and live. That is, it had pressure at wellhead 11 of approximately 108 PSI but valves were closed to prevent the gas from flowing. The plot is substantially a straight line. Plot or curve 83 represents pressure monitored at various depths while the well was flowing, but still without heat being supplied by heater cable 34. Note that the flowing plot 83 parallels shut-in plot 81 generally from the total depth to approximately 3000'. The pressure from 6000 feet to 3000 feet is approximately 3 to 5 PSI less while flowing, but generally on the same slope as while shut-in. At about 3000 feet, plot 83 changes to a much shallower slope. The slope from about 3000 to 1000 feet is still linear, but is substantially shallower than the slope of shut-in plot 81. There is a sharp increase in slope around 800 to 1000 feet, then plot 83 resumes its shallow slope until reaching wellhead 11. The slope of flowing plot 83 changes at point 87, which is the point along the production tubing 21 where liquid droplets have collected in sufficient quantities to cause a large increase in pressure gradient. Significant condensation is occurring at point 87, which thus drops the pressure and flow rate from 3000 feet up. The condition at and above point 87 is created by water droplets falling downward due to gravity and then collecting in slugs, which greatly restrict flow. Production gasses either have to bubble through the water slugs or the water slugs have to be pushed up the well by gas pressure.

The dashed line extending from point 87 upward at the same slope as the lower portion of flowing plot 83 indicate the theoretical pressures that would occur along the well from 3000 feet to the surface if condensation were not occurring. The pressure at the surface would be approximately 95 PSI rather than 60 PSI, thus resulting in a greater flow rate. The greater flow rate not only enables an operator to produce faster for additional cash flow but also may prevent a well from being abandoned because of a low flow rate, the abandonment resulting in residual gas remaining in the formation that does not get produced. The purpose of heater cable 34 (FIG. 1) is to apply enough heat to cause plot 83 to remain more nearly linear at the same slope as in the lower portion.

A video camera was also run through the well being measured in FIG. 5, and it confirmed that substantial condensation droplets existed approximately at the depths from 3000 feet to 1000 feet. Plots 81, 83 were made in a conventional manner by lowering a pressure monitor on a wire line into the well.

FIG. 6 is a graph of depth versus temperature of a well with heat being supplied by heater cable 34 and without heat being supplied. Plot 89 is an actual measurement of the temperature gradient while the well was flowing but without heater cable 34 supplying heat. This plot was obtained by measuring the temperature at various points along the depth of the well. Plot 89 is approximately linear and differs only in slight amounts from a geothermal gradient of the well. Plot 91 represent temperature measurements made while heater cable 34 (FIG. 1) was being supplied with power. The temperature is considerably greater throughout the well, being about 60° to 80° higher than without power being supplied to heater cable 34. The temperature difference depends on the structure of electrical cable 34 as well as the amount of power being supplied to electrical cable 34. The test also showed that the gas flow rate increased substantially when heated as indicated by plot 91 in FIG. 6. Condensate in the well was reduced greatly, the pressure at the surface increased, and the flow rate increased significantly. In one well, gas flow increased from about 100 mcf (thousand cubic feet) to 500–600 mcf. The temperature difference in that well average about 75 degrees over the length of heater cable 34.

As mentioned, it is not necessary to maintain the gas at a temperature and pressure far above its dew point, rather the temperature should be only sufficient to avoid enough condensation that causes significant frictional losses. The well needs to be heated an amount sufficient to reduce droplets of condensation and thus the friction caused by them. Further, it may not be necessary to add as much heat in the upper portion of the well, such as the upper 1000 feet, because there will be insufficient residence time in this section for droplets to build up in sufficient quantity to cause any significant increase in pressure gradient. That is before condensation droplets have time to fall downward and form water slugs in the flow stream, they will have exited the well. Increasing the temperature far above the dew point would not be economical because it requires additional energy to create the heat without reducing the detrimental pressure gradient. The flow rate or gas pressure at wellhead 11 can be monitored at the surface and power to heater cable 34 varied accordingly by controller 37. For example, the power could be reduced or turned off until the flowing pressure decreased a sufficient amount to again begin supplying power.

Alternately, downhole sensors could be employed that monitor the temperature and/or pressure within the production tubing and turn the power to the heater cable on and off accordingly. Furthermore, when applying a vacuum to the tubing annulus 75, particularly when using heat reflective liners 26 or 28 (FIG. 1*a*), it may not be necessary to utilize heater cable 34 to apply heat. When heat losses to the earth formation are greatly reduced in this manner, the gas flowing through production tubing 21 may have enough heat within it to avoid detrimental condensation. In some cases, heater cable 34 may be necessary for heating only initially or occasionally.

Figure 7:
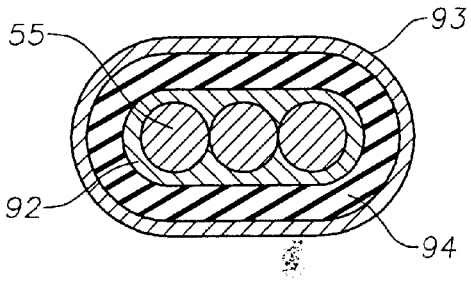
FIG. 7 is a sectional view of an alternate embodiment of a lower termination for the heater cable of FIG. 1.

There are a number of variations to different components of the system. FIG. 7 shows a transverse cross section of an alternate lower termination to the one shown in FIG. 3. A copper block 92 is crimped around the three copper conductors 52, shorting them together. A cannister or sheath 93 encloses block 92 and conductors 52. An insulating compound 94 is filled in the spaces surrounding conductors 52 and block 92. In the embodiment of FIG. 7, dielectric liquid 51 (FIG. 3), reservoir 67 and siphon tube 65 are not required.

Figure 8:
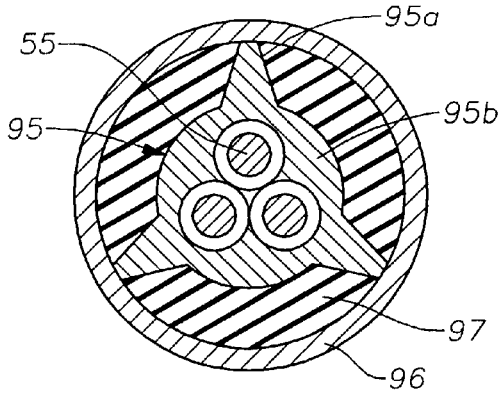
FIG. 8 is a sectional view of an alternate embodiment of the heater cable of the well of FIG. 1.

FIG. 8 shows a heater cable that is constructed generally as shown in U.S. Pat. No. 6,103,031. The three insulated conductors 55 are twisted together and located within a spacer or standoff member 95 that has three legs 95*a* spaced 120 degrees apart and a central body 95*b*. Conductors 55 are located within central body 95*b*. Standoff member 95 is preferably a plastic material extruded over the twisted conductors 55 and is continuous along the lengths of conductors 55. A metal tubing 96 extends around standoff member 95. An insulation filler material 97 may surround standoff member 95 within tubing 96.

An advantage of the heater cable of FIG. 8 is the small diameter of tubing 96 that is readily achievable. A larger diameter for the heater cable reduces the cross-sectional flow area for the gas flow up production tubing 21 (FIG. 1). The heater cable of FIG. 8 has an outer diameter no greater than one inch, and may be as small as one-half inch.

To manufacture the heater cable of FIG. 8, conductors 55 are formed within standoff member 95 and placed along a strip of metal. The metal is bent into a cylindrical configuration and welded to form the tubing 96. Legs 95*a* of standoff member 95 position conductors 55 away from the sidewall of tubing 96 to avoid heat damage during welding. Filler material 97 maybe pumped into tubing 96 after it has been welded.

Figure 9:
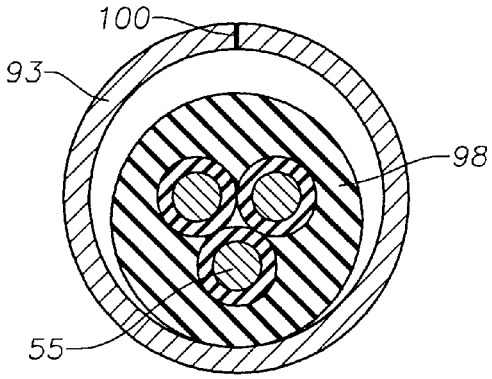
FIG. 9 is a sectional view of another alternate embodiment of the heater cable shown in FIG. 1, shown prior to the outer coiled tubing being swaged.
Figure 10:
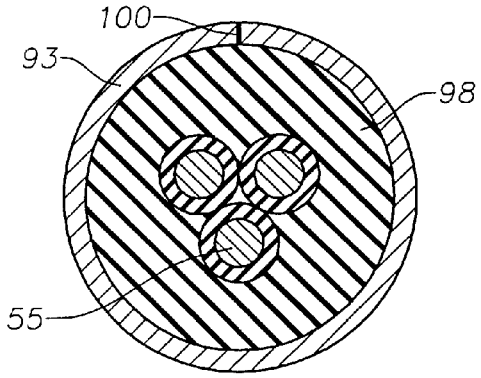
FIG. 10 is a sectional view of the heater cable of FIG. 9, shown after the outer coiled tubing is swaged.

In the heater cable embodiment of FIG. 9, an elastomeric jacket 98 is extruded over insulated conductors 55. Jacket 98 is placed on a flat metal strip, which is bent and welded at seam 100 to form tubing 93. The inner diameter of tubing 93 is initially larger than the outer diameter of jacket 98, although the difference would not be as great as illustrated in FIG. 9. Then tubing 93 is swaged to a smaller diameter as shown in FIG. 10, with the inner diameter of tubing 93 in contact with the outer diameter of jacket 98. Having an initial larger diameter allows conductors 55 and jacket 98 to be located off center of the center of tubing 93 during the welding process. Seam 100 can be located on an upper side of tubing 93, while jacket 98 contacts the lower side of tubing 93 due to gravity. This locates conductors 55 farther from weld 55 while weld 55 is being made than if conductors 55 were on the center of tubing 93. This off center placement reduces the chance for heat due to welding from damaging conductors 55. After swaging, the center of the assembly of conductors 55 will be concentric with tubing 93, as shown in FIG. 10. The heater cable of FIG. 10 also has an outer diameter in the range from one-half to one inch.

Figure 11:
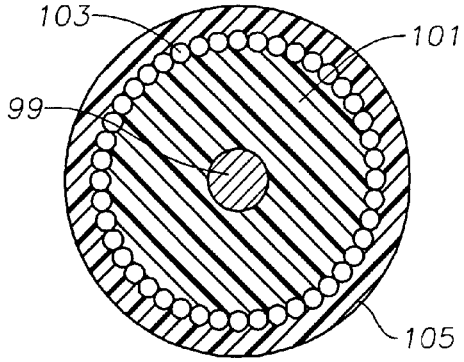
FIG. 11 is a sectional view of another alternate embodiment of the heater cable for the well of FIG. 1.

FIG. 11 shows a single phase conductor 99, rather than the three phase electrical cable 34 of FIG. 4. Also, this heater cable does not have an outer armor and is not located within coiled tubing. The heater cable of FIG. 11 includes a copper conductor 99 of low resistivity. An electrical insulation layer 101 surrounds conductor 99, and is exaggerated in thickness in the drawing. Because of the depth of most gas wells, a strengthening member 103 is formed around layer 101 to prevent the heater cable from parting due to its own weight. The strengthening member 103 could be aramid fiber or metal of stronger tensile strength than copper, such as steel. In this embodiment, strengthening member 103 surrounds insulation layer 101, resulting in an annular configuration in transverse cross action. An elastomeric jacket 105 is extruded over strengthening member 103 to provide protection. If desired, the return for the single phase power could be made through strengthening member 103, which although not as a good of a conductor as copper conductor 99, will conduct electricity.

Because of its ability to support its on weight, the heater cable of FIG. 11 would be deployed directly in production tubing 21 (FIG. 1) without coiled tubing 27. In shallow wells, say less than about 5000 feet, it may not be necessary to use a strengthening member. Rather, the copper conductor 99 could be formed of hard drawn copper or a copper alloy such as brass or bronze, rather than annealed copper, adding enough strength to support the weight of the cable in shallow wells. The outer diameter of the heater cable of FIG. 11 is preferably from one-half to one inch.

Figure 12:
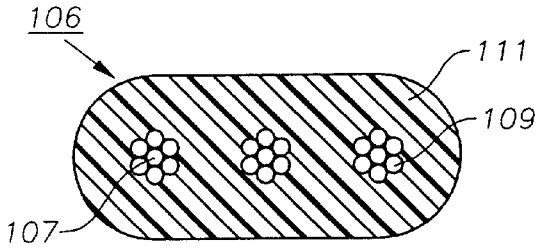
FIG. 12 is a sectional view of another alternate embodiment of the heater cable for the well of FIG. 1.

In FIG. 12, the outer configuration of the heater cable is shown to be flat, having two flat sides and two oval sides, rather than cylindrical. However, electrical cable 106 could also have a cylindrical configuration. Electrical cable 106 is also constructed so as to be strong enough to support its own weight. It has three separate copper conductors 107, thus is to be supplied with three phase power. It has strengthening members 109 surrounding and twisted with each of the copper conductors 107. Each strengthening member 109 may be of conductive metal, such as steel or of a non-conductor such as an aramid fiber. Strengthening members 109 have greater tensile strength than copper conductors 107. An elastomeric jacket 111 surrounds the three assemblages of conductors 107 and strengthening members 109. It is not necessary to have outer armor. Coiled tubing will not be required, either.

Figure 13:
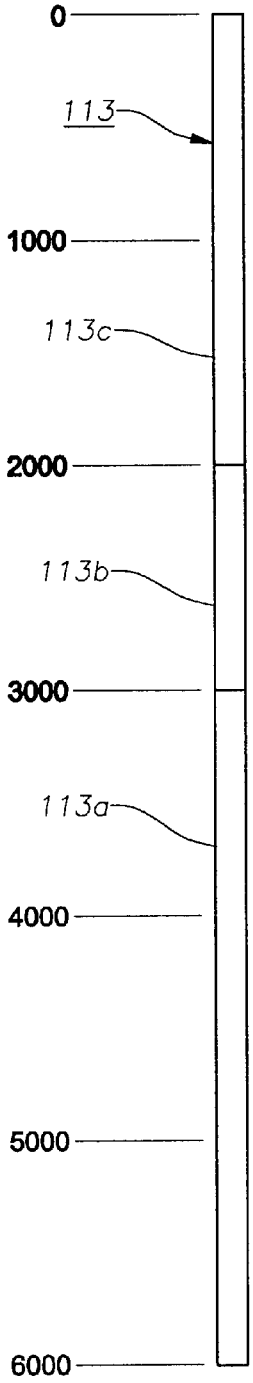
FIG. 13 is a schematic view of a heater cable as in FIG. 1 having different heat producing capacities along its length.

FIG. 13 shows another variation for electrical cable in lieu of electrical cable 34. FIG. 13 schematically illustrates an electrical cable 113 within a well, with the well depths listed on the left side. The amount of heat required at various points along the depth of the well is not the same in all cases. In some portions of the well, the gas may be near or above the dew point naturally, while in other points, well below the dew point. Consequently, it may be more feasible to supply less heat in certain portions of the well than other portions of the well to reduce the consumption of energy.

In FIG. 13, electrical cable 113 maybe of any one of the types shown in FIGS. 2, 4, 7–10 or any other suitable type of electrical cable for providing heat. However, portions of the length of the electrical cable 113 will have different properties than others. For example, portion 113*a*, which is at the lower end, maybe made of larger diameter conductors than the other portions so that less heat is distributed and less power is consumed. Portion 113*b* may have smaller conductors than portion 113*a* or 113*c*. Portion 113*b* would thus provide more heat due to the smaller conductors than either portion 113*a* or 113*c*. Similarly,portion 113*c* may have larger conductors than portion 113*b* but smaller than portion 113*a*. This would result in an intermediate level of heat being supplied in the upper portion of the well. There are other ways to vary the heat transfer properties other than by varying the cross sectional dimensions. Changing the types of insulation or types of metal of the conductors will also accomplish different heat transfer characteristics.

Figure 14:
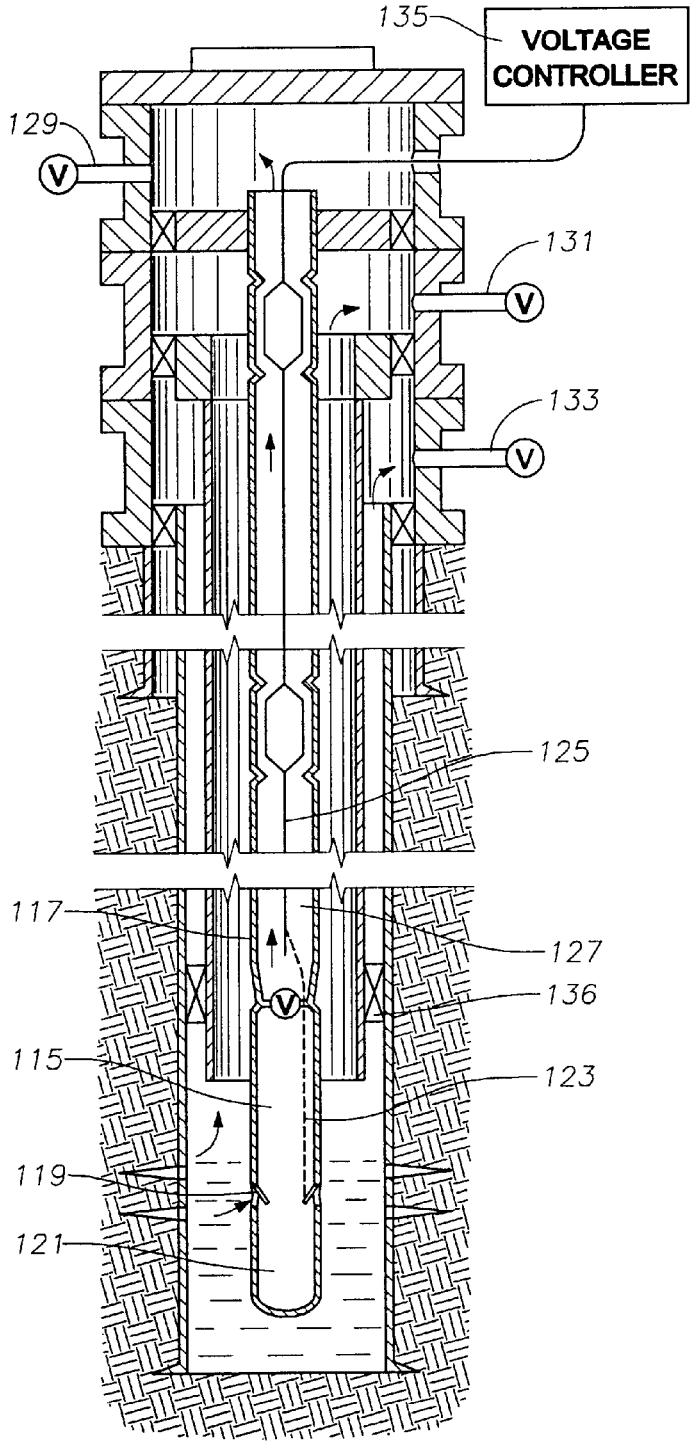
FIG. 14 is a schematic view of a well having a pump as well as a heater cable.

FIG. 14 illustrates a variation of the system of FIG. 1. Some water may also be produced from the formation along with saturated gas, and this water collects in the bottom of the well. If too much water collects in a low pressure gas well, it can greatly restrict the perforations and even shut in the well. In the system of FIG. 14, a pump 115 is located at the bottom of the well. In this example, pump 115 is secured to the lower end of coiled tubing 117. Pump 115 has an intake 119 for drawing liquid condensate in that is collected in the bottom of the well. Pump 119 need not be a high capacity pump, and could be a centrifugal pump, a helical pump, a progressing cavity pump, or another type. Preferably, pump 115 is driven by an electrical motor 121. The electrical power line 123 is preferably connected to electrical cable 125 that also supplies heat energy for heating the gas. A downhole switch (not shown) has one position that connects line 123 to cable 125 to supply power to pump 115. The switch has another position that shorts the terminal ends of the three conductors of cable 125 to supply heat rather than power to pump 115.

In the embodiment of FIG. 14, heater cable 125 has a continuous annulus 127 surrounding it within coiled tubing 117. Preferably, pump 115 will have its discharge connected to coiled tubing 117 for flowing the condensate up the inner annulus 127. The flow discharges out the open upper end of coiled tubing 117 and flows out a condensate flow line 129 leading from the wellhead. Gas will be produced out production tubing 131. A vacuum pump connected to port 133 will reduce the pressure within the annulus surrounding production tubing 134. A voltage controller 135 will not only control the heat applied to electrical cable 125, but also control turning on and off the downhole switch at pump motor 121. Additionally, if desired, a surface actuated isolation valve 136 can be placed between pump 119 and the interior of coiled tubing 117 so that the system can be deployed in a live well without fear that gas will enter coiled tubing 117 and flow to the surface.

Automatic controls can be installed on the surface to shut off the heater cable function and activate pump motor 121 whenever excessive water builds up in the well. This condition can be determined by evaluating pressure and flow rate conditions on the surface, by scheduling regular pumping periods to keep the well dry, or by measuring the pressure at the bottom of the well directly with instruments installed at the bottom of the assembly. A downhole pressure activated switch or other suitable means can be employed to automatically cut off pump motor 121 when the condensate drops below intake 119.

Figure 15:
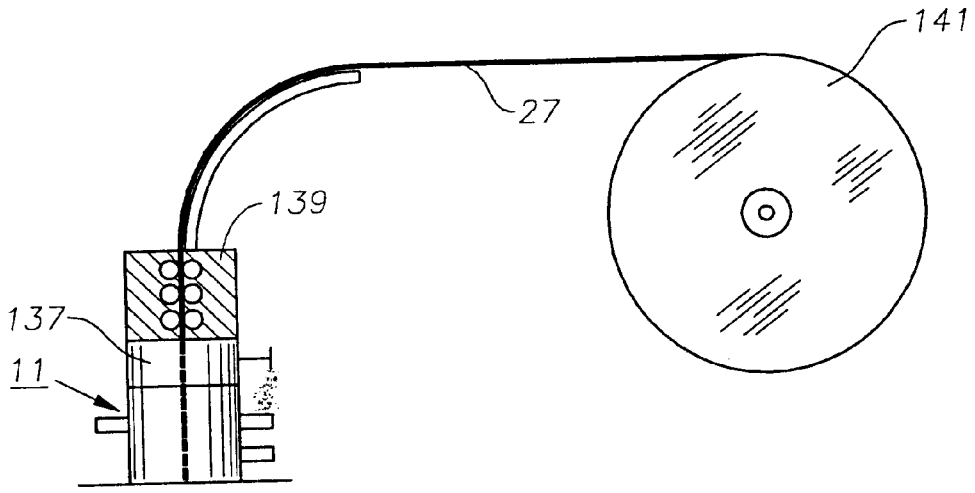
FIG. 15 is a schematic view of one method of deploying the heater cable of FIG. 1 into the well while live, showing a coiled tubing injector and snubber.

FIG. 15 represents a preferred method of installing the system shown in FIG. 1. The system of FIG. 1 is live well deployable. That is, pressure will still exist at wellhead 11 while coiled tubing 27 is being inserted into the well, although production valves 73, 79 maybe closed in. It is important to be able to install heater cable 34 (FIG. 1) while the well is live to avoid having to kill the well to install the new system. Killing low pressure gas wells is a very risky business because there is a good chance that the operator will not get the well back. When the reservoir energy is low, there may be insufficient pressure to push the kill fluid out of the formation and/or water may flow into the well faster than it can be swabbed out. If this happens, the well cannot be recovered and all production is lost. By installing the system in a live well, the risk of losing the well is avoided.

The preferred method of FIG. 12 utilizes a pressure controller, which is a snubber or blowout preventer 137 of a type that will seal on a smooth outer diameter of a line, such as coiled tubing 27 or the heater cables of FIGS. 7–12, and allow it to simultaneously be pushed downward into the well. Blowout preventer 137 is mounted to wellhead 11 and has an injector 139 mounted on top. Injector 139 is of a conventional design that has rollers or other type of gripping members for engaging coiled tubing 27 and pushing it into the well. Blowout preventer 137 simultaneously seals on the exterior of coiled tubing 27 in this snubbing type of operation. Electrical cable 34 (FIG. 1) will be installed in coiled tubing 27 at the surface, then coiled tubing 27 is wrapped on a large reel 141. Reel 141 is mounted on a truck that delivers coiled tubing 27 to the well site. It is important that coiled tubing 27 be smooth on the outside for the snubbing operation through blowout preventer 137.

This system of FIG. 15 could also be utilized with electrical cables that have the ability to support their own weight and are not within coiled tubing, such as shown in FIGS. 11 and 12. The heater cables of FIGS. 11 and 12 are brought to the well site on a reel and deployed through stripper rubbers of blowout preventer 137. The heater cables of FIGS. 11 and 12 must be impervious to the flow of gas and be able to support their own weight when suspended from the top of well during installation and operation. A sinker or weight bar can be attached to the lower end of the heater cables of FIGS. 11 and 12 to help the cables to slide down the well without getting caught.

Figure 16:
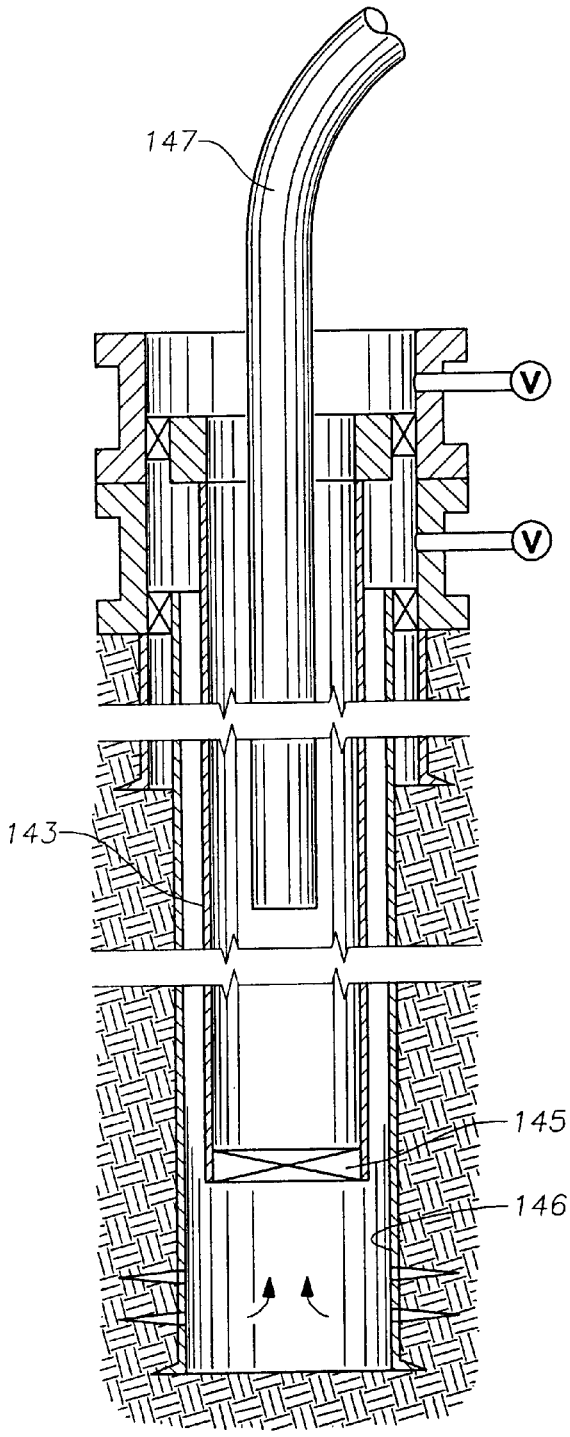
FIG. 16 is a schematic view of another method of deploying the heater cable of FIG. 1 into the well while live, showing production tubing that has been isolated from well pressure by a plug.

FIG. 16 illustrates another live well deployable system. In FIG. 16, a coiled tubing injector is not required for installing the heater cable. Rather, a wireline deployable plug 145 will be installed first in production tubing 143. The installation of plug 145 can be done by conventional techniques, using a blowout preventer with a stripper that enables plug 145 to be snubbed in. Once plug 145 is deployed, the wire line is removed. The interior of production tubing 143 will now be isolated from the pressure in casing 146. The operator then lowers a heater cable assembly 147 into production tubing 143. Heater cable assembly 147 may comprise coiled tubing having an electrical cable such as in any of the embodiments shown, or it may be a self-supporting type as in FIGS. 11 and 12. Once fully deployed in the well, heater cable assembly 147 is sealed at the surface. Then, plug 145 will be released. The releasing of plug 145 will communicate gas to the interior of production tubing 143 again. The releasing may be accomplished in different manners. One manner would be to apply pressure from the surface to cause a valve within plug 145 to release. Another method might be to pump a fluid into the well that will destroy the sealing ability of plug 145.

Figure 17:
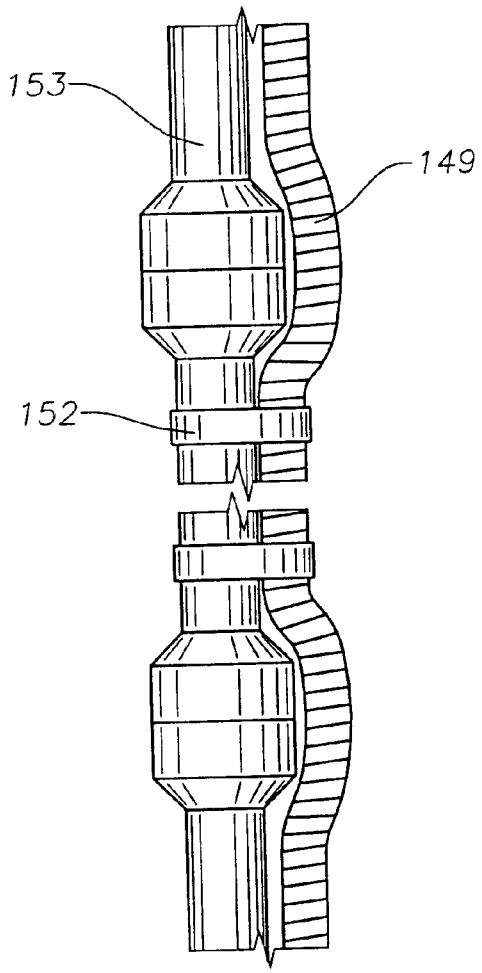
FIG. 17 is a side view of heater cable being supported by sucker rod, rather than located within coiled tubing.

FIG. 17 shows another type of heater cable assembly that could be employed in lieu of coiled tubing supported heater cable 34 (FIGS. 1 and 7–10) or self-supporting heater cables of FIGS. 11 and 12. It would be employed in production tubing 143 (FIG. 13) or in another conduit that is isolated from well pressure by plug 145. Heater cable 149 is strapped to a string of sucker rod 153 or some other type of tensile supporting member. Heater cable 149 may be electrical cable such as shown in U.S. Pat. No. 5,782,301. Sucker rod 153 comprises lengths of solid rod having ends that are screwed together. Sucker rod 153 is commonly used with reciprocating rod well pumps. Straps 152 will strap electrical cable 149 to the string of sucker rod 153 at various points along the length. The assembly of FIG. 16 is lowered in production tubing 143 of FIG. 16, then plug 145 is released.

Another embodiment, not shown, may be best understood by referring again to FIG. 1. In FIG. 1, electrical cable 34 is installed in coiled tubing 27 at the surface prior to installing coiled tubing 27 in the well with injector 139. Alternately, self-supporting electrical cable, such as the embodiments of FIGS. 11 and 12, could be installed in coiled tubing 27 after it has been lowered in place. Because coiled tubing 27 has a closed lower end 29, it will be isolated from pressure within production tubing 21. Self supporting cable, such as those shown in FIGS. 11 and 12, could be lowered into coiled tubing 27 from another reel. A weight or sinker bar could be attached to the end of the heater cable.

Figure 18:
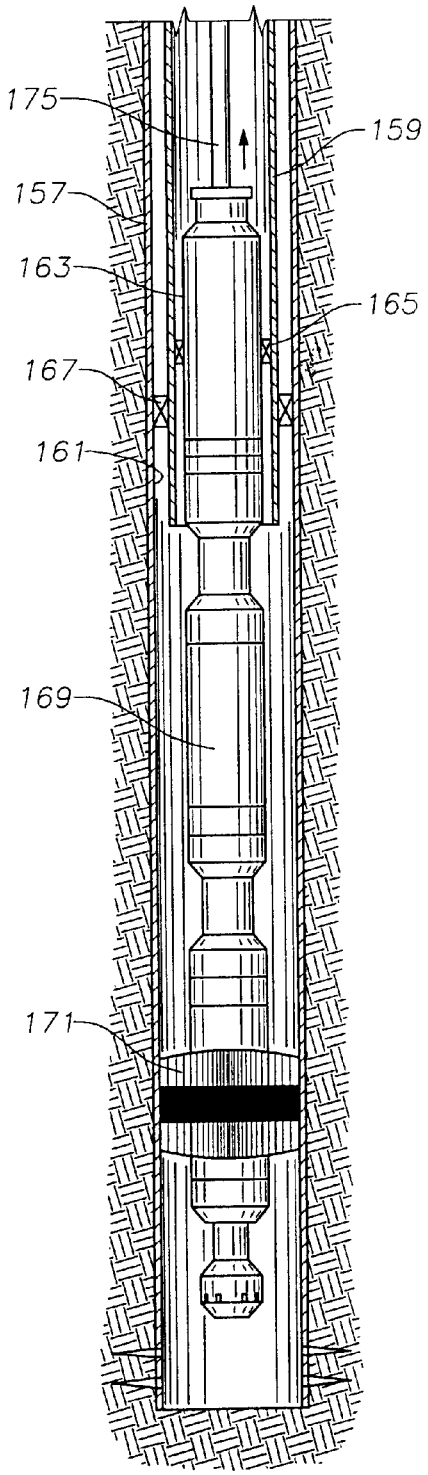
FIG. 18 is a sectional view of another method of deploying heater cable while the well is live, using a through tubing deployed packer.

FIG. 18 illustrates still another method of installing heater cable within a live well, particularly a well that does not have a packer already installed between the tubing and the casing. The well has a production casing 157 cemented in place. Production tubing 159 is suspended in casing 157, defining a tubing annulus 161. Unlike FIG. 1, there is no packer located near the lower end of tubing 159 to seal the lower end of tubing annulus 161. To prepare for a live well installation of heater cable, a hanger mandrel 163 is lowered into tubing 159 and set near the lower end of tubing 159. A locking element 165 will support the weight of hanger mandrel 163. Seals 167 on the exterior of mandrel 163 seal mandrel 163 to the interior of tubing 159. Seals 167 may be energized during the landing procedure of mandrel 163 in tubing 159.

Typically mandrel 163 has an extension joint 169 extending below it. A packer 171 is mounted to extension joint 169. Packer 171 has a collapsed configuration that enables it to be lowered through tubing 159, and an expanded position that causes it to seal against casing 157, as shown. Once packer 171 has set, tubing annulus 161 will be sealed from production flow below packer 171. Hanger mandrel 163 has an interior passage that allows gas flow from the perforations below packer 171 to flow up production tubing 159.

Hanger mandrel 163 may be lowered by a wireline, which is then retrieved. Although pressure will exist in tubing 159 while hanger mandrel 163 is being run, a conventional snubber will seal on mandrel 163 and the wireline to while being run. When hanger mandrel 163 has landed within tubing 159, packer 171 will be located below the lower end of tubing 159. The operator then sets packer 171 in a conventional manner. Heater cable 175, which maybe any one of the types described, is lowered into production tubing 159 to a point above mandrel 163 by using a snubber at the surface. Packer 171 allows the operator to draw a vacuum in tubing annulus 161 by a vacuum pump at the surface, so as to provide thermal insulation to tubing 159. The operator supplies power to heater cable 175 to heat gas flowing up tubing 159.

Prior to installing heater cable with any of the methods described above, calculations of the amount of energy to be deployed should be made. Pressure and temperature surveys should be made to determine the depth at which the water is building up in the tubing, causing the pressure gradient to greatly increase. The heat transfer rate to raise the production fluid temperature by the required amount is calculated. In order to do this, one must determine the heat transfer coefficient at the outer diameter of the coiled tubing 27 (FIG. 1). The temperature needed at the outer diameter of the coiled tubing 27 to supply the required heat transfer rate is calculated. The heat transfer resistance from the coiled tubing 27 to casing 15 (FIG. 1) is determined. The heat transfer resistance from the heated production fluid to casing 15 is calculated. The heat transfer resistance from casing 15 to the earth formation is calculated. All of the heat transfer resistances are summed.

The heat transfer coefficient for fluid inside of coiled tubing 27 to the inner diameter of coiled tubing is determined. The temperature of fluid inside coiled tubing 27 to deliver the summed heat transfer rate is determined. The heat transfer coefficient at heater cable 34 (FIG. 4) surface is determined. The temperature of the heater cable surface 34 to deliver the summed heat transfer rate is calculated. The heat transfer coefficient from heater cable conductors 55 (FIG. 4) to heater cable outer surface 41 is calculated. The temperature of heater cable conductors 55 to deliver the summed heat transfer rate is calculated. The electrical resistance of the heater cable conductors is measured. The amperage needed to deliver the watt equivalent of the summed heat transfer rate is computed. The applied voltage needed to cause the desired amperage in the heater cable is then calculated.

The invention has significant advantages. Deploying the heater cable while the well is live avoids the risk of not being able to revive the well if it is killed. Once deployed, the heat generated by the heater cable reduces condensation, increasing the pressure and flow rate of the gas.

While the invention has been shown in only a few of its forms, it should not be limited to the embodiments shown, but is susceptible to various modifications without departing from the scope of the invention.

What is claimed is:

1. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated; and (e) flowing gas up past the cable assembly and out the wellhead; wherein step (a) comprises inserting an electrical cable into a string of coiled tubing to form the cable assembly, providing an inner annulus within the coiled tubing between the cable and the coiled tubing; and the method further comprises placing a liquid in the inner annulus to increase heat transfer from the cable to the coiled tubing.

2. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead; and wherein the conductor has at least two sections along its length, one of the sections providing a different amount of heat for a given amount of power than the other section, to apply different amounts of heat to the gas at different places in the well.

3. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead;

wherein the well has a string of production tubing suspended within casing, and a packer set to define a closed lower end to a tubing annulus between the casing and the tubing, and wherein the method further comprises reducing a pressure of gas contained in the tubing annulus to below atmospheric pressure that exists at the surface of the well.

4. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead;

(f) mounting a pump to the lower end of the coiled tubing, and pumping condensate of the gas out of the well;

wherein step (a) comprises placing an electrical cable within a string of coiled tubing to form the cable assembly; and coiled wherein the pump flows the condensate up an inner annulus between the cable and the tubing.

5. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead;

wherein the well contains a production tubing located within a production casing, the production tubing having an open lower end for the flow of the gas, and step (c) comprises:

closing the open lower end of the production tubing; then lowering the cable assembly into the production tubing and sealing an upper end of the cable assembly to the wellhead; then opening the lower end of the production tubing.

6. The method according to claim 5, wherein the lower end is closed by installing a closure member within the production tubing; and the lower end is opened by releasing the plug member from blocking the production tubing.

7. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead; wherein step (a) comprises providing an electrical cable with at least one strengthening member incorporated therein for supporting weight of the cable, the strengthening member having a higher tensile strength than the conductor: and step (d) comprises supplying power to the strengthening member as well as to the conductor.

8. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead;

providing a string of production tubing within the well into which the cable assembly is lowered and through which the gas flows upward, and providing the production tubing with an inner passage having a heat reflective coating.

9. A method of heating gas being produced in a well to reduce condensate occurring in the well, comprising:

(a) providing a cable assembly having at least one insulated conductor;

(b) coiling the cable assembly on a reel and transporting the cable assembly to a well site;

(c) deploying the cable assembly from the reel into the well while the well is still live;

(d) applying electrical power to the conductor to cause heat to be generated;

(e) flowing gas up past the cable assembly and out the wellhead;

providing a string of production tubing within the well into which the cable assembly is lowered and through which the gas flows upward, the production tubing being suspended within a string of casing, and providing the casing with an inner diameter having a heat reflective coating.

10. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; and reducing pressure within a tubing annulus surrounding the production tubing to less than atmospheric to reduce heat loss from the production tubing to the casing.

11. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; wherein step (a) comprises:

forming a standoff member around the conductor, the standoff member having a plurality of legs extending outward from a central body;

placing the standoff member on a strip of metal; and bending the metal into a cylindrical configuration and welding a seam to define a tube surrounding the standoff member.

12. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; and wherein the conductor has at least two sections along its length, one of the sections providing a different amount of heat for a given amount of power than the other section, to apply different amounts of heat to the gas at different places in the well.

13. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; and wherein step (a) comprises insulating the conductor and installing the conductor within a string of coiled tubing.

14. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; and providing the production tubing an inner passage having a heat reflective coating.

15. A method of reducing condensate occurring in a gas well, the well having a production tubing suspended within casing, the method comprising:

(a) providing a cable assembly having at least one conductor;

(b) coiling the cable assembly on a reel and transporting the cable assembly to a well site;

(c) installing a pressure controller at an upper end of the production tubing, sealing around the cable assembly with the pressure controller, and deploying the cable assembly from the reel into the production tubing while well pressure still exists within the production tubing; then (d) applying electrical power to the conductor to cause heat to be generated at a temperature within the production tubing that is sufficient to retard condensation;

(e) flowing gas up the production tubing past the cable assembly and out the wellhead; and providing the casing with an inner diameter having a heat reflective coating.

16. A method of reducing condensate occurring in a gas well, the well having a production tubing suspended within casing, defining a tubing annulus between the casing and the tubing, the method comprising:

(a) providing a heater cable assembly having three insulated conductors located within a string of coiled tubing;

(b) coiling the cable assembly on a reel and transporting the cable assembly to a well site;

(c) shorting lower ends of the conductors together;

(d) installing a pressure controller at an upper end of the production tubing, sealing around the cable assembly with the pressure controller, and deploying the cable assembly from the reel into the production tubing while well pressure still exists within the production tubing;

(e) with a vacuum pump located at the surface of the well, reducing pressure within the tubing annulus to below atmospheric pressure;

(f) flowing gas up the production tubing past the cable assembly and out the wellhead; and (g) applying electrical power to the conductors to cause heat to be generated at a temperature within the production tubing that is sufficient to retard condensation of gas flowing up the production tubing.

17. The method according to claim 16, wherein step (a) comprises providing the cable assembly with an outer diameter no greater than one inch.

18. The method according to claim 16, wherein step (a) comprises:

twisting the conductors together to form a conductor assembly and forming a standoff member around the conductor assembly, the standoff member having a plurality of legs extending outward from a central body;

placing the standoff member on a strip of metal;

bending the metal into a cylindrical configuration and welding a seam to define a tube surrounding the standoff member.

19. The method according to claim 16, wherein the heater cable assembly has at least two sections along its length, one of the sections providing a different amount of heat for a given amount of power than the other section, to apply different amounts of heat to the gas at different places in the well.

20. The method according to claim 16, further comprising providing the production tubing an inner passage having a heat reflective coating.

21. The method according to claim 16, further comprising providing the casing with an inner diameter having a heat reflective coating.

* * * * *

UNITED STATES PATENT AND TRADEMARK OFFICE

CERTIFICATE OF CORRECTION

PATENT NO. : 6,585,046 B2 
DATED : July 1, 2003
INVENTOR(S) : David H. Neuroth et al.

It is certified that error appears in the above-identified patent and that said Letters Patent is hereby corrected as shown below:

Title page,
Item [57], ABSTRACT,
Line 5, after "allowed" insert -- to flow --

Column 1,
Line 27, insert -- a -- before "significant"

Column 4,
Lines 2-7, delete the sentence beginning and ending with "There are ...snubbing operations."

Column 6,
Line 32, delete "represent" and insert therefor -- represents --
Line 45, delete "average" and insert therefor -- averaged --

Column 13,
Line 35, delete "coiled" before "wherein"
Line 64, delete "plug" and insert therefor -- closure --

Signed and Sealed this

Seventh Day of October, 2003

JAMES E. ROGAN
*Director of the United States Patent and Trademark Office*